US012091800B2

(12) United States Patent
Lee et al.

(10) Patent No.: US 12,091,800 B2
(45) Date of Patent: Sep. 17, 2024

(54) LAUNDRY TREATMENT APPARATUS

(71) Applicant: LG Electronics Inc., Seoul (KR)

(72) Inventors: Jihong Lee, Seoul (KR); Kwanwoong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 661 days.

(21) Appl. No.: 17/384,009

(22) Filed: Jul. 23, 2021

(65) Prior Publication Data

US 2022/0120008 A1 Apr. 21, 2022

(30) Foreign Application Priority Data

Oct. 15, 2020 (KR) ..... 10-2020-0133270

(51) Int. Cl.
*D06F 34/20* (2020.01)
*D06F 23/04* (2006.01)
(Continued)

(52) U.S. Cl.
CPC ..... *D06F 34/20* (2020.02); *D06F 23/04* (2013.01); *D06F 29/005* (2013.01); *D06F 31/00* (2013.01); *D06F 34/28* (2020.02); *D06F 37/24* (2013.01); *D06F 39/083* (2013.01); *D06F 39/088* (2013.01); *D06F 39/125* (2013.01); *D06F 39/14* (2013.01); *D06F 2103/40* (2020.02); *D06F 2105/58* (2020.02); *D06F 2105/60* (2020.02)

(58) Field of Classification Search
CPC ..... D06F 34/20; D06F 23/04; D06F 29/005; D06F 31/00; D06F 34/28; D06F 37/24; D06F 39/083; D06F 39/088; D06F 39/125; D06F 39/14; D06F 2103/40; D06F 2105/58; D06F 2105/60; D06F 33/47; D06F 2103/00; D06F 2105/50; D06F 2105/62; D06F 39/00; D06F 58/20; D06F 34/34; D06F 37/12; D06F 39/085
See application file for complete search history.

(56) References Cited

FOREIGN PATENT DOCUMENTS

| | | |
|---|---|---|
| CN | 1496426 | 5/2004 |
| CN | 101680152 | 3/2010 |

(Continued)

OTHER PUBLICATIONS

Office Action in Chinese Appln. No. 202111142549.0, mailed on Mar. 25, 2023, 16 pages(with English translation).

(Continued)

*Primary Examiner* — Jessica Yuen
(74) *Attorney, Agent, or Firm* — Fish & Richardson P.C.

(57) ABSTRACT

Disclosed herein is a laundry treatment apparatus including a cabinet including an upper cover, a first side cover and a second side cover, a cover through hole formed through the upper cover, and an outlet formed in a front surface of the cabinet, a drawer including a drawer body, and a drawer panel fixed to the drawer body, a tub arranged in the drawer body, a drum rotatably arranged inside the tub, an operation part having one end rotatably fixed to the first side cover and a free end, a contact portion exposed to an outside of the cabinet and configured to move toward an inside of the cabinet and toward the cover through hole, a converter configured to move the free end, and a position sensor configured to sense a position of the free end when the outlet is closed to sense closure of the outlet.

19 Claims, 6 Drawing Sheets

(51) Int. Cl.

| | |
|---|---|
| ***D06F 29/00*** | (2006.01) |
| ***D06F 31/00*** | (2006.01) |
| ***D06F 34/28*** | (2020.01) |
| ***D06F 37/24*** | (2006.01) |
| ***D06F 39/08*** | (2006.01) |
| ***D06F 39/12*** | (2006.01) |
| ***D06F 39/14*** | (2006.01) |
| ***D06F 103/40*** | (2020.01) |
| ***D06F 105/58*** | (2020.01) |
| ***D06F 105/60*** | (2020.01) |

(56) References Cited

FOREIGN PATENT DOCUMENTS

| | | | | |
|---|---|---|---|---|
| CN | 102312363 | | 1/2012 | |
| CN | 108368662 | | 8/2018 | |
| EP | 2949802 | A1 * | 12/2015 | ..... D06F 29/005 |
| EP | 3112516 | A1 * | 1/2017 | ..... D06F 34/20 |
| KR | 20200046411 | | 5/2020 | |
| KR | 20200069731 | | 6/2020 | |
| WO | WO2020076118 | | 4/2020 | |

OTHER PUBLICATIONS

Extended European Search Report in European Appln. No. 21186552.2, dated Dec. 23, 2021, 10 pages.

* cited by examiner

LAUNDRY TREATMENT APPARATUS

CROSS-REFERENCE TO RELATED APPLICATION

This application claims the benefit of Korean Patent Application No. 10-2020-0133270, filed on Oct. 15, 2020, which is hereby incorporated by reference as if fully set forth herein.

TECHNICAL FIELD

The present disclosure relates to a laundry treatment apparatus.

BACKGROUND

In general, a laundry treatment apparatus is a concept including a washing machine configured to wash clothes (objects to be washed), a dryer configured to dry clothes (objects to be dried), and a complex apparatus capable of both washing and drying clothes.

A conventional laundry treatment apparatus includes a cabinet arranged to support a washing machine or dryer, a drawer arranged to be withdrawn from the cabinet, a tub arranged inside the drawer to store water, a drum arranged inside the tub to store laundry, a water supplier configured to supply water into the tub, and a drainage part configured to discharge water from the tub to the outside of the cabinet.

The drawer-type laundry treatment apparatus described above should be operated only when the drawer is inserted into the cabinet to prevent leakage of water stored in the tub. Accordingly, for the conventional drawer-type laundry treatment apparatus, a sensor to detect whether the drawer is inserted into the cabinet is required.

In addition, in the conventional drawer-type laundry treatment apparatus, when the drawer is withdrawn from the cabinet, the center of gravity of the apparatus is shifted along the drawer, and as a result, the drawer-type laundry treatment apparatus may be inclined in a direction in which the drawer is drawn out. In order to address such an issue, a sensor to detect whether another object such as a washing machine is seated on the top surface of the cabinet is required (Korean Patent Application Publication No. 10-2020-0069731).

SUMMARY

An object of the present disclosure is to provide a drawer-type laundry treatment apparatus that is configured to support an apparatus for treating laundry (a dryer, a washing machine, a drying/washing machine, etc.) and is capable of washing laundry.

Another object of the present disclosure is to provide a laundry treatment apparatus capable of detecting whether a drawer is inserted into a cabinet and whether an object (a dryer, a washing machine, a drying/washing machine, etc.) is seated on the top surface of the cabinet using with one sensor.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a laundry treatment apparatus includes a cabinet including an upper cover defining a space to seat an object therein, a first side cover and a second side cover forming a side surface of the cabinet, a cover through hole formed through the upper cover in a penetrating manner, and an outlet formed in a front surface of the cabinet, a drawer including a drawer body arranged to be drawn out of the cabinet through the outlet, and a drawer panel fixed to the drawer body to open and close the outlet, a tub arranged in the drawer body to provide a space for storing water, a drum rotatably arranged inside the tub to store laundry, an operation part having one end rotatably fixed to the first side cover and a free end, the free end being configured to move between a first point closer to the first side cover than to the drawer body and a second point closer to the drawer body than the first side cover, a contact portion exposed to an outside of the cabinet through the cover through hole and configured to move toward an inside of the cabinet when brought into contact with the object seated on the upper cover and to move toward the cover through hole when not in contact with the object, a converter configured to move the free end to the second point when the contact portion moves toward the inside of the cabinet and to move the free end to the first point when the contact portion moves toward the cover through hole, and a position sensor configured to sense a position of the free end when the outlet is closed by the drawer panel to sense the outlet closed by the drawer panel and sense the free end positioned at the second point.

The position sensor may sense whether the free end is positioned at the second point when the drawer panel closes the outlet.

The position sensor may be arranged in an area located within a predetermined reference distance from the second point in a space provided by the drawer body when the drawer panel closes the outlet.

The laundry treatment apparatus may further include a magnet fixed to the free end of the operation part, wherein, based on a magnetic force of the magnet being greater than or equal to a preset reference value, the position sensor may determine that the outlet is closed by the drawer panel and the free end is positioned at the second point.

The position sensor may include a sensor configured to contact the free end and generate a control signal when the drawer panel closes the outlet and the free end is positioned at the second point.

The laundry treatment apparatus may further include a lamp provided at the free end of the operation part to emit light, wherein, based on an intensity of light emitted from the lamp being greater than or equal to a preset reference value, the position sensor may determine that the outlet is closed by the drawer panel and the free end is positioned at the second point.

The laundry treatment apparatus may further include a driving part configured to rotate the drum, and a controller configured to control the driving part and receive a control signal transmitted by the position sensor, wherein the controller may operate the driving part only when the drawer panel closes the outlet and the free end is positioned at the second point.

The laundry treatment apparatus may further include a control panel fixed to the drawer panel and exposed to the outside of the cabinet, and a notification part provided on the control panel to output at least one of a character and a sound, wherein the notification part may output a warning message or a warning sound when the drawer panel does not close the outlet, or when the free end is not positioned at the second point.

The laundry treatment apparatus may further include a water supplier configured to supply water to the tub, a drainage part configured to discharge water stored in the tub to the outside of the cabinet, a driving part configured to rotate the drum, and a controller configured to control the water supplier, the drainage part, and the driving part and to receive a control signal transmitted by the position sensor, wherein the controller may skip operating at least one of the water supplier, the drainage part, or the driving part when the drawer panel does not close the outlet, or when the free end is not positioned at the second point.

The laundry treatment apparatus may further include a case fixed to the first side cover and positioned under the cover through hole, and a rotation shaft configured to rotatably fix one end of the operation part to the case. The contact portion may include a contact body exposed to the outside of the cabinet through the cover through hole, and an insertion body formed through the case in a penetrating manner, the insertion body having one end fixed to the contact body and an opposite end positioned inside the case. The converter may include a slide configured move in the case in the same direction as a movement direction of the insertion body, a slit formed through the slide in a penetrating manner, the slit having a straight path parallel to the movement direction of the insertion body and an inclined path provided at one end of the straight path to be inclined toward the first side cover, and a connection shaft having one end inserted into the slit and an opposite end fixed to the operation part.

The laundry treatment apparatus may include a first drawer support configured to fasten the drawer body to the first side cover such that the drawer body may be withdrawn from the cabinet, and a second drawer support configured to fasten the drawer body to the second side cover such that the drawer body may be withdrawn from the cabinet, wherein the case may be fixed to the first side cover so as to be positioned above the first drawer support. Thereby, the volume of the cabinet may be minimized.

The laundry treatment apparatus may further include a protrusion provided on one of the slide and the case, and a path defining part provided on the other one of the slide and the case to define a movement path of the protrusion.

The case may include a case body fixed to the first side cover to rotatably fix the operation part, and a case cover fixed to the case body. The protrusion may include a first protrusion provided on a surface facing the case body, and a second protrusion provided on a surface facing the case cover. The path defining part may include a first protrusion guide provided on the case body to define a movement path of the first protrusion, and a second protrusion guide provided on the case cover to define a movement path of the second protrusion.

The laundry treatment apparatus may further include an interference prevention hole formed through the case body in a penetrating manner to prevent the free end positioned at the first point from interfering with the case body.

The laundry treatment apparatus may further include a case body fixed to the first side cover to rotatably fix the operation part, a case cover fixed to the case body, and a contact portion guide provided through a top surface of the case body in a penetrating manner to define a movement path of the insertion body.

The laundry treatment apparatus may further include a spring configured to press the slide toward the cover through hole.

The object may include a second cabinet, a second drum rotatably arranged inside the second cabinet to provide a space to accommodate laundry, a second driving part configured to rotate the second drum, and a pressing part provided to the second cabinet and configured to press the contact portion into the cabinet when the second cabinet is seated on the upper cover.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Reference will now be made in detail to the preferred embodiments of the present disclosure, examples of which are illustrated in the accompanying drawings. Elements or control method of an apparatus which will be described below are only intended to describe the embodiments of the present disclosure and are not intended to restrict the scope of the present disclosure. Wherever possible, the same reference numbers will be used throughout the drawings to refer to the same or like parts.

Figure 1:
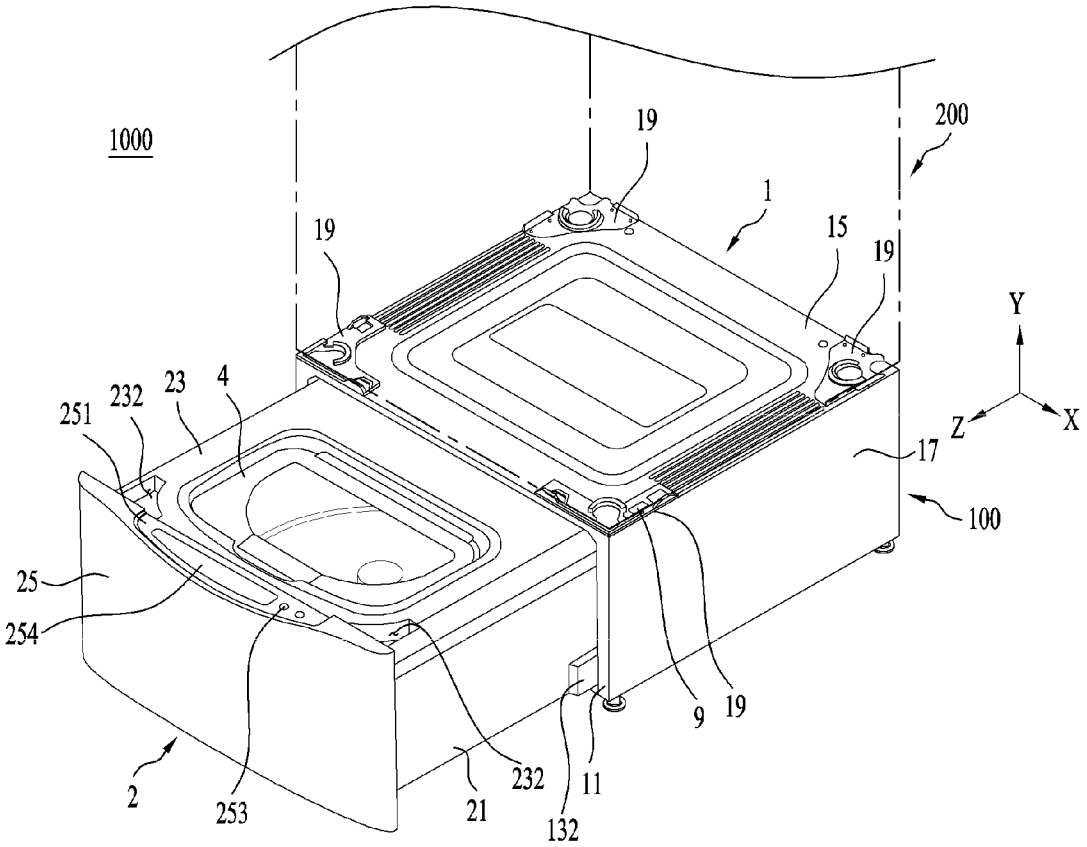
FIG. 1 shows an example of a laundry treatment apparatus.

As shown in FIG. 1, a laundry treatment apparatus 1000 may include a first treatment apparatus 100 capable of washing or drying laundry and a second treatment apparatus 200 seated on a top surface of the first treatment apparatus 100 and capable of washing or drying laundry.

The first treatment apparatus 100 may include a cabinet 1 providing a space in which an object is seated, a drawer 2 arranged to be drawn out of the cabinet, an accommodation portion 3 arranged inside the drawer to define a space to accommodate water and laundry, and a door 4 configured to open and close the accommodation portion.

Figure 2:
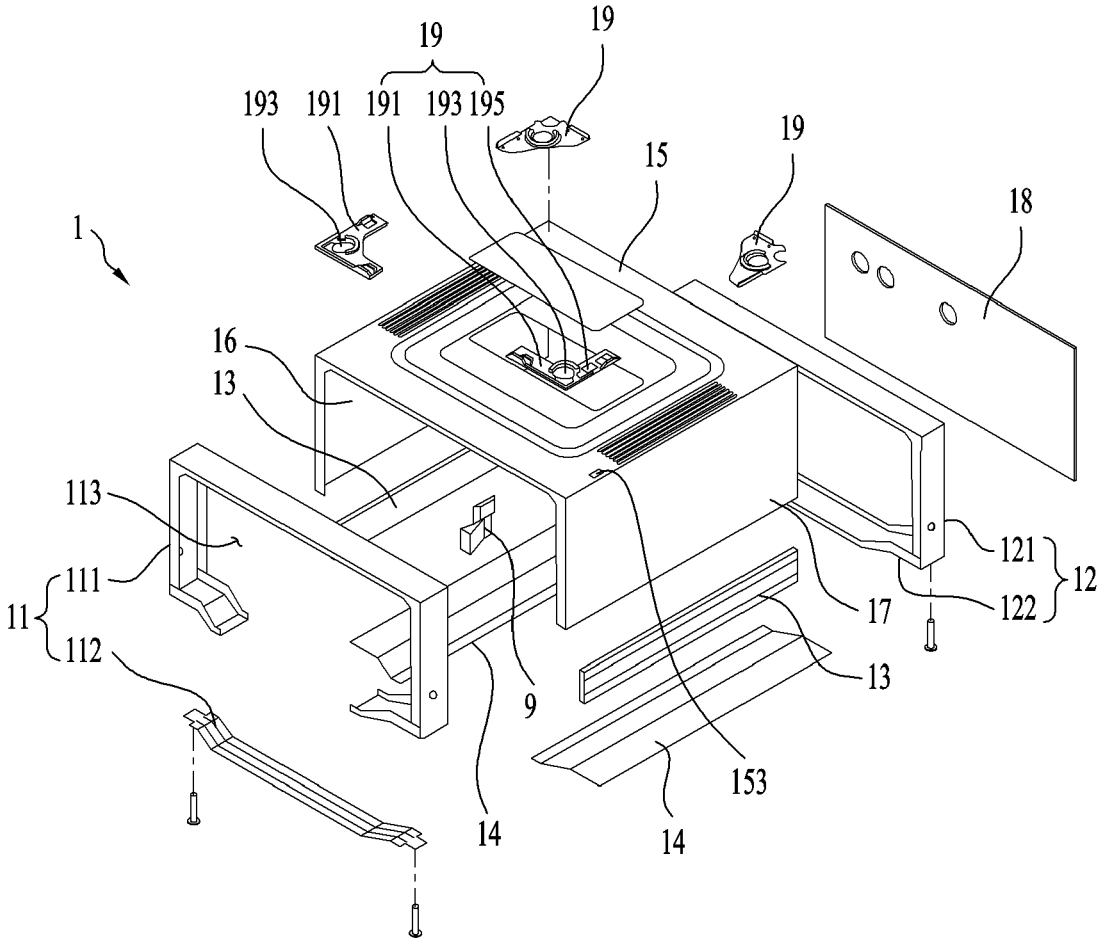
FIG. 2 shows an example of a cabinet.

As shown in FIG. 2, the cabinet 1 may include an upper cover 15 providing a space in which an object such as the second treatment apparatus 200 is seated, a first side cover 16 and a second side cover 17 provided to opposite ends of the upper cover to define both side surfaces of the first treatment apparatus 100, and a rear cover 18 defining a rear surface of the first treatment apparatus 100. The upper cover 15, the first side cover 16, and the second side cover 17 may be formed by bending opposite ends of one metal plate.

The front of the cabinet 1 is provided with an outlet 113 through the drawer 2 moves in and out. The outlet 113 may be provided by configuring the front of the cabinet 1 as an open front or by forming a through hole in a front cover defining the front surface of the cabinet 1.

In order to firmly support objects such as the second treatment apparatus 200, the cabinet 1 may be provided with a front frame 11, a rear frame 12, and a frame connector 14 to which the covers 15, 16, 17, and 18.

The front frame 11 may be disposed at the front of the cabinet 1, and the rear frame 12 may be disposed at the rear of the cabinet 1. The frame connector 14 may be arranged to connect the bottom surface of the front frame 11 and the bottom surface of the rear frame 12.

The front frame 11 may include a first frame body 111 and a first support frame 112. The first frame body 111 may have a C shape and include a surface to which the front of the upper cover 15 is fixed, a surface to which the front of the first side cover 16 is fixed, and a surface to which the front of the second side cover 17 is fixed. The first support frame 112 may be arranged to connect both ends (two free ends) of the first frame body 111.

When the first frame body 111 and the first support frame 112 having the above-described structure are coupled to each other, a frame through hole may be formed in the center, and the outlet 113 may be configured as the frame through hole.

The rear frame 12 may include a second frame body 121 and a second support frame 122. The second frame body 121 may have a C shape and include a surface to which the rear of the upper cover 15 is fixed, a surface to which the rear of the first side cover is fixed, and a surface to which the rear of the second side cover is fixed. The second support frame 122 may be arranged to connect both ends (two free ends) of the second frame body 121.

The frame connector 14 may and include a first frame connector configured to connect the first support frame 112 and the second support frame 122, the first frame connector being fixed on a side facing the first side cover 16, and a second frame connector configured to connect the first support frame 112 and the second support frame 122, the second frame connector being fixed on a side facing the second side cover 17.

The rear cover 18 may be detachably fixed to the rear frame 12, and each of the first support frame 112 and the second support frame 122 may be provided with a leg on the surface thereof on which the cabinet 1 is seated.

The upper cover 15 may be provided with a seating portion 19. The seating portion 19 is a means to fix the second treatment apparatus 200 or a storage apparatus to the upper cover 15 when the apparatus is mounted on the top of the first treatment apparatus 100. The seating portion 19 may include a seating body 191 fixed to each corner of the upper cover 15 and a leg fastening part 193 provided on the seating body.

The leg fastening part 193 is a means to couple the legs (protrusions, etc.) provided on the bottom surface of the second treatment apparatus 200 or the like to the seating body 191. The leg fastening part 193 may be configured as a seating body through hole formed through the seating body 191 in a penetrating manner, or as a seating body groove formed by concavely bending the surface of the seating body 191 with respect to the upper cover 15.

The upper cover 15 is provided with a cover through hole 151, and the seating body 191 is provided with a body through hole 195 communicating with the cover through hole 151. The cover through hole 151 and the body through hole 195 are means to expose the contact portion provided to a sensor 9 to the outside of the cabinet 1, and specific functions thereof will be described later.

Figure 3:
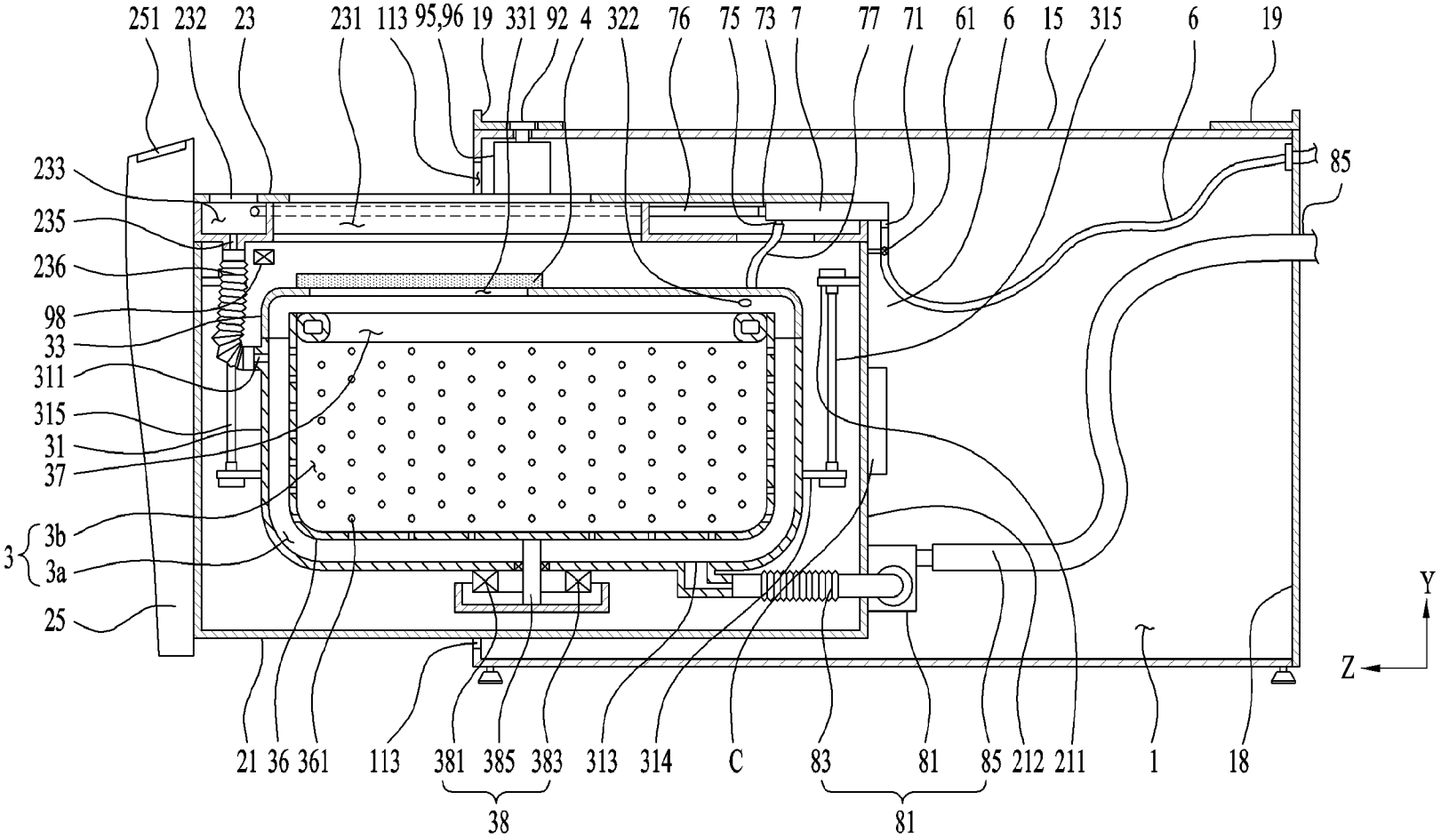
FIG. 3 shows an exemplary cross-sectional view of the laundry treatment apparatus.

As shown in FIG. 3, the drawer 2 may include a drawer body 21 having a shape allowed to be withdrawn from the inside of the cabinet 1, the drawer body providing a space in which the accommodation portion 3 is fixed, a drawer cover 23 defining a top surface of the drawer body 21, and a drawer panel 25 fixed to the drawer body 21 and positioned outside the cabinet 1.

The drawer body 21 may be formed in any shape as long as it can be withdrawn from the cabinet 1 through the outlet 113. FIG. 3 shows an example in which the drawer body 21 has a hexahedral shape with an open top. The drawer cover 23 is fixed to the open face of the drawer body 21, and the drawer panel 25 is fixed to the front surface of the drawer body 21.

As shown in FIG. 2, the drawer body 21 may be retrievably fixed to the cabinet 1 through drawer supports 131 and 132. A first side surface of the drawer body 21 (i.e., a surface facing the first side cover) may be fixed to the cabinet 1 through the first drawer support 131, and the second side surface of the drawer body 21 (i.e., a surface facing the second side cover) may be fixed to the cabinet 1 through the second drawer support 132.

The first drawer support 131 may include a first fixed frame fixed to the front frame 11 and the rear frame 12, and a first sliding frame retrievably coupled to the first fixed frame and fixed to the first side surface of the drawer body 21. Similarly, the second drawer support 132 may include a second fixed frame fixed to the front frame 11 and the rear frame 12, and a second sliding frame retrievably coupled to the second fixed frame and fixed to the second side surface of the drawer body 21.

As shown in FIG. 1, the drawer panel 25 may have a shape capable of opening the outlet 113 when the drawer body 21 is withdrawn from the cabinet 1, and closing the outlet 113 when the drawer body 21 is inserted into the cabinet 1. Opening the outlet 113 by the drawer panel 25 means that the outlet 113 is exposed to the outside of the first treatment apparatus, and closing the outlet 113 means that the outlet 113 is not exposed to the outside of the first treatment apparatus (this does not mean that the outlet must be sealed or the drawer panel must be configured to seal the edge of the outlet).

A control panel 251 may be provided on one surface (e.g., top surface, etc.) of the drawer panel 25. The control panel 251 may include an input unit 253 and a notification part 254. The input unit 253 is a means to receive a control command from a user, and the notification part 254 is a means to provide the user with various kinds of information related to the operation of the first treatment apparatus. The notification part 254 may be a display panel or a speaker.

As shown in FIG. 3, the drawer cover 23 is provided with a cover through hole 231 allowing the inside of the drawer body 21 to communicate with the outside. In addition, the drawer cover 23 may include a detergent storage part 233 to store detergent, and a detergent supply port 232 communicating with the detergent storage part through the top surface of the drawer cover. The detergent storage part 233 receives water through a water supplier, which will be described later. The detergent and water supplied to the detergent storage part 233 move to the accommodation portion 3 through a discharge pipe 235.

The accommodation portion 3 may include a tub **3*a* fixed to the drawer body 21 to provide a space for storing water, and a drum 3*b*** rotatably arranged inside the tub to provide a space for accommodating laundry.

The tub **3*a* may include a tub body 31 to store water, and a tub cover 33 defining the top surface of the tub body. The tub body 31 may be formed in a cylindrical shape with an open top, and the tub cover 33 may be formed in a cylindrical shape with an open bottom and be fixed to an upper end of the tub body 31**.

The tub body 31 may be fixed to the drawer body 21 through a tub support 315. The tub support 315 may be configured a bar connecting a first bracket 211 provided on the drawer body 21 and a second bracket 314 provided on the circumferential surface of the tub body.

A detergent supply port 311 connected to the discharge pipe 235 may be provided on the circumferential surface of the tub body 31, and a drain port 313 through which water inside the tub body is discharged may be provided on the bottom surface of the tub body 31.

The tub cover 33 is provided with an inlet 331 allowing the inside of the tub body 31 to communicate with the outside, and a water supply port 332 through which water is supplied to the tub body 31. The inlet 331 is opened and closed by the door 4. The door 4 may be configured to reciprocate between a point where the inlet 331 is closed (a closed point) and a point where the inlet 311 is opened (an open point, a point where the inlet is opened by 80% or more). Here, both the closed point and the open point may be set to points located inside the space defined between the tub cover 33 and the drawer cover 23.

When the door is coupled to the tub cover by a hinge, the free end of the door must be drawn out to the outside of the drawer through the cover through hole 231 when the inlet is opened. To dry the tub in this structure (i.e., to open the inlet to remove residual water from the tub), the drawer must be withdrawn from the cabinet. This is because if the drawer is inserted into the cabinet while the inlet is opened by the door, the drawer may not be removed from the cabinet. When the inlet 331 is opened with the drawer withdrawn, foreign matter may be introduced into the tub. However, as shown in FIG. 3, when the door 4 is arranged to be slidable within the space defined between the tub cover 33 and the drawer cover 23 (refer to the arrow), the tub may be dried even with the drawer remaining inserted into the cabinet.

The drum 3*b* may include a hollow cylindrical drum body 36 and a drum inlet 37 formed through the top surface of the drum body in a penetrating manner.

The drum body 36 may be rotated in the tub 3*a* through a driving part 38. The driving part 38 include a stator 381 fixed to the bottom surface of the tub body 31 to create a rotating magnetic field, a rotor 383 rotated by the rotating magnetic field, a drum rotation shaft 385 arranged through the bottom surface of the tub body to connect the bottom surface of the drum body 36 and the rotor 383.

Drum through holes 361 are provided in the circumferential surface and the bottom surface of the drum body 36. Accordingly, the water stored in the tub body 31 may be supplied into the drum body 36 through the drum through holes 361, and water or foreign matter inside the drum body 36 may be discharged to the tub body 31 through the drum through holes 361.

The drum inlet 37 is located under the inlet 331, which is opened and closed by the door 4, and the inlet 331 is positioned under the cover through hole 231 provided in the drawer cover. In this case, when the drawer 2 is withdrawn from the cabinet 1, the door 4 located under the cover through hole 237 will be exposed to the outside of the cabinet 1. The user may open the door 4 to open the inlet 331. Then, the user may supply laundry into the drum 3*b* or withdraw laundry stored in the drum to the outside of the drawer.

The tub 3*a* is supplied with water through the water supplier 6, 7, and the water stored in the tub 3*a* is discharged to the outside of the cabinet 1 through a drainage part 8.

The drainage part 8 may include a pump 81 fixed to the rear surface 212 (body rear surface) of the drawer body, a first drain pipe 83 connecting the pump 81 and the drain port 313 of the tub, and a second drain pipe 85 configured to guide the water discharged from the pump 81 to the outside of the cabinet 1.

The water supplier includes a detergent storage part 233, a dispenser 7 configured to supply water to the water supply port 332 of the tub, and a connection pipe 6 connecting the dispenser and a water supply source.

The dispenser 7 may be provided with a first passage connecting the supply port 71 and the first discharge port 73 and a second passage connecting the supply port 71 and the second discharge port 75. In this case, the connection pipe 6 may be connected to the supply port 71, and the detergent storage part 233 is supplied with water through the first water supply pipe 76 connected to the first discharge port 73. The water supply port 332 may receive water through a second water supply pipe 77 connected to the second discharge port 75.

The connection pipe 6 and the supply port 71 may be connected through a valve 61. The valve 61 may be configured to open and close the connection pipe 6 according to a control signal from a controller C.

The first treatment apparatus 100 includes a sensor 9 configured to detect whether the drawer 2 is inserted into the cabinet 1 and whether an object such as the second treatment apparatus 200 is seated on the top surface of the cabinet 1.

Figure 4:
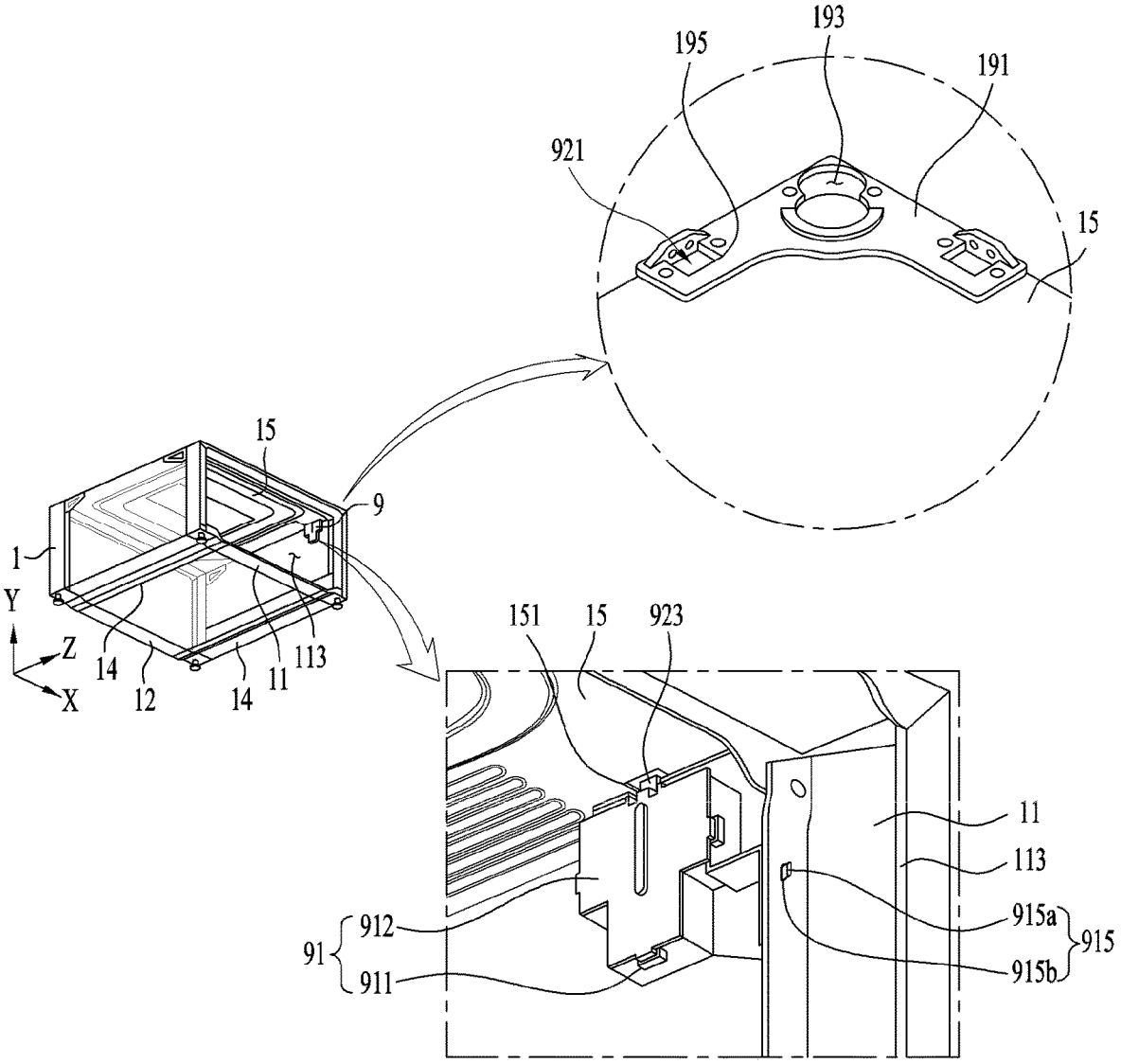
FIGS. 4 and 5 show an example of a sensor.

As shown in FIG. 4, the sensor 9 may include a case 91 fixed to the cabinet 1, and a contact portion 92 having one end exposed to the upper cover 15 through the body through hole 195 and an opposite end positioned inside the case 91.

The case 91 is may be arranged in a space defined between the first side cover 16 of the cabinet and a side surface of the drawer body 21 or in a space defined between the second side cover 17 of the cabinet and a side surface of the drawer body 21. FIG. 4 illustrates that the case 91 is positioned between the first side cover 16 and the side surface of the drawer body 21 as an example.

The case 91 may be fixed to the first side cover 16 of the cabinet, or may be fixed to the front frame 11 to be fixed in the space between the first side cover 16 and the drawer body 21. FIG. 4 illustrates the latter case. In this case, the sensor 9 may be provided with a case fixing part 915.

The case fixing part 915 may include a fastening protrusion 915*a* protruding from the case 91 and a fastening hole 915*b* provided in the front frame 11 and allowing the fastening protrusion to be inserted thereinto.

Figure 5:
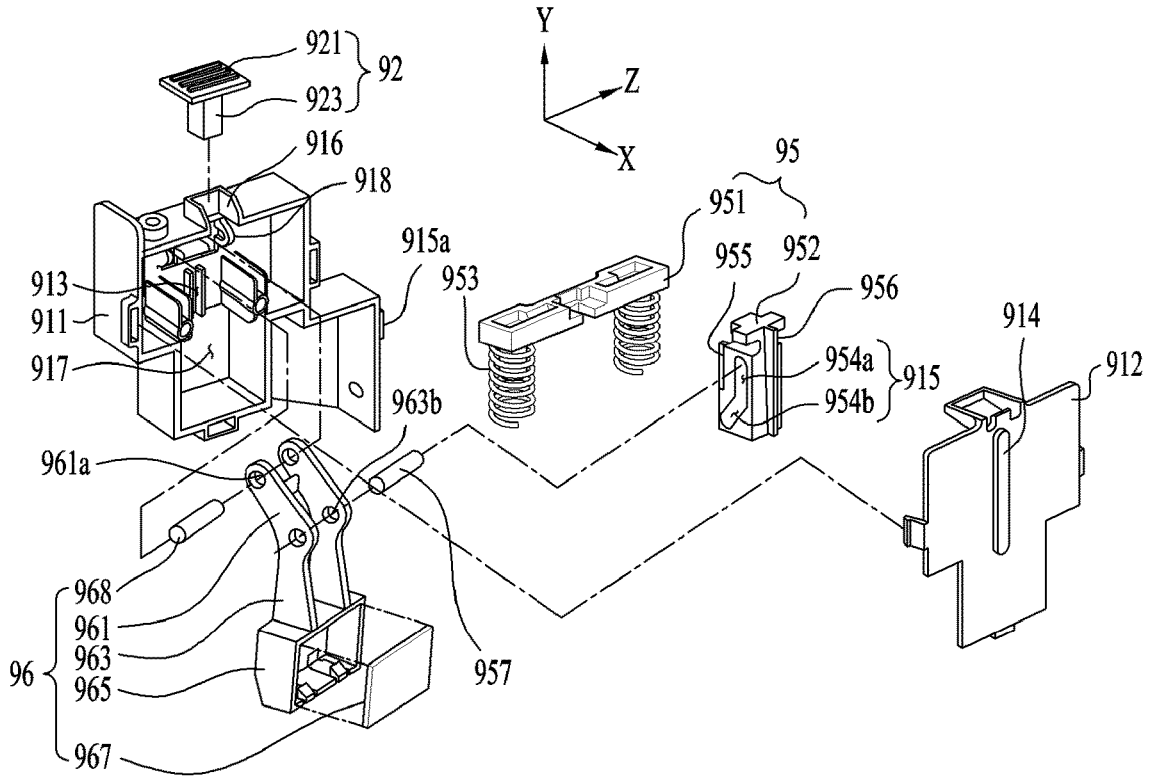

As shown in FIG. 5, the case 91 may include a case body 911 fixed to the cabinet 1 through the case fixing part 915, and a case cover 912 fixed to the case body 911.

The case body 911 may be formed in a hexahedral shape with an open surface facing the drawer body 21, and the case cover 912 may be configured to close the open surface of the case body 911. A top surface of the case body 911 (a surface of the case body facing the upper cover) may be provided with a first case through hole 916 into which one end of the contact portion 92 is inserted.

The contact portion 92 may include an insertion body 923 inserted into the first case through hole 916, and a contact body 921 fixed to the insertion body and exposed to the upper cover 15 through the cover through hole 151 and the body through hole 195.

The contact body 921 is movable toward the inside of the cabinet 1 by the weight of an object seated on the upper cover 15. Accordingly, when an object such as the second treatment apparatus 200 is seated on the upper cover 15 (i.e., when the second treatment apparatus or the like is coupled to the seating portion), the contact body 921 moves toward the inside of the cabinet 1, and the insertion body 923 moves toward the bottom surface of the case body 911. Since the insertion body 923 is inserted into the first case through hole 916, the first case through hole 916 functions as a guide (contact portion guide) defining a movement path of the contact body 921.

the case 91 includes an operation part 96 configured to reciprocate between a side on which the case body 911 is located (the side on which the first side cover is located) and a side on which the case cover 912 is located (the side on which the side surface of the drawer body is located), and a converter 95 configured to convert the linear motion of the contact portion 92 into a reciprocating motion of the operation part.

Figure 6B:
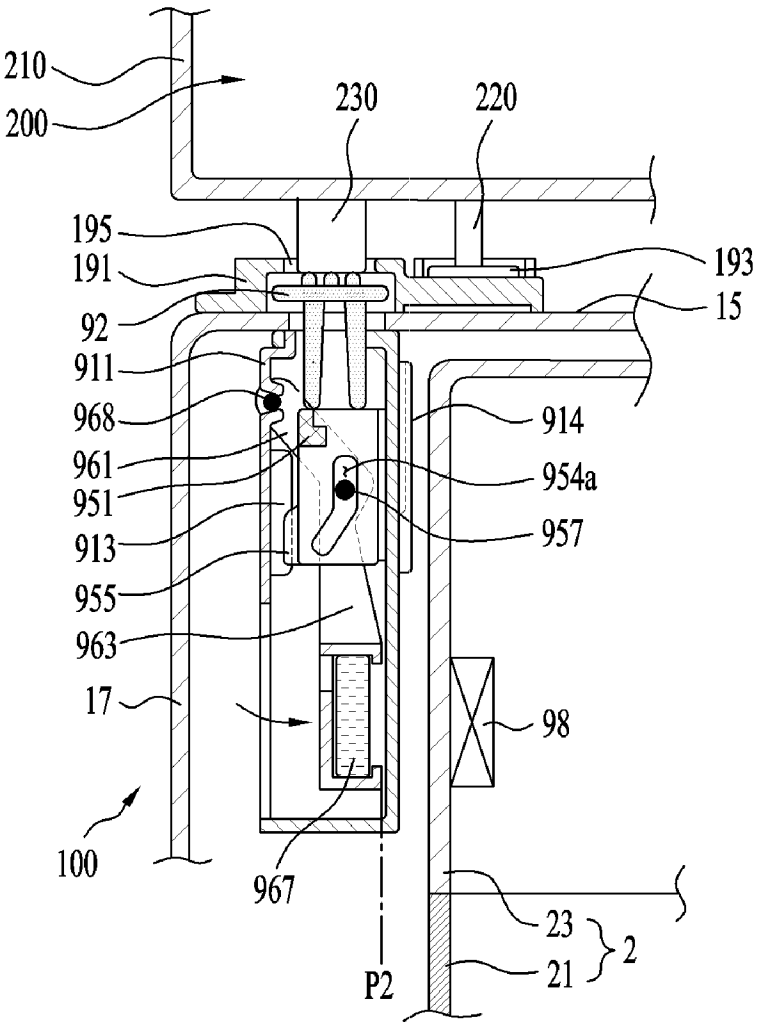
FIGS. 6A and 6B illustrate operation of the sensor.

One end of the operation part 96 may be rotatably fixed to the case body 911, and a free end thereof may be provided with a bar reciprocating between a first point P1 (see FIG. 6A) and a second point P2 (see FIG. 6B). The first point may be set to a point close to the case body 911 (a point close to the first side cover) in the inner space of the case 91, and the second point may be set to a point close to the case cover 912 (a point close to the side surface of the drawer body) in the inner space of the case 91.

Referring to FIG. 5, the operation unit 96 may include a first body 961 having a fixed end coupled to the case body 911, and a second body 963 extending from the first body and provided with the free end.

The first body 961 is coupled to the case body 911 by a rotation shaft 968. In this case, the first body 961 may have a rotation shaft through hole 961*a* through which the rotation shaft 968 is arranged, and the case body 911 may have a shaft support 918 to which the rotation shaft 968 is fixed.

A mounting body 965 to which a permanent magnet 967 is fixed may be provided at the free end of the second body 963. The case body 911 may be provided with a second case through hole 917. The second case through hole 917 is a means (interference prevention hole) to prevent contact between the mounting body 965 and the case body 911 when the mounting body 965 is positioned at the first point. When the case 91 is fixed to the front frame 11, a space may be created between the case body 911 and the first side cover 16. Accordingly, when the case body 911 is provided with the second case through hole 917, the thickness of the case 91 (the length of the case along the X-axis direction) may be minimized (i.e., the volume of the case may be minimized), and the distance between the first point and the second point may be maximized.

For example, the first drawer support 131 is provided on the side surfaces of the first side cover 16 and the drawer body 21. Accordingly, a space corresponding to the thickness (length along the X-axis) of the first drawer support 131 is created between the side surfaces of the first side cover 16 and the drawer body 21. When the case 91 is fixed to the front frame 11 and positioned above the first drawer support 131, the second case through hole 917 may minimize the thickness of the case and the distance between the first point and the second point may be set long. The distance between the first point and the second point may minimize a detection error of a position sensor, which will be described later.

The converter 95 may include a slide 951, 952 configured to move in the case 91 in the same direction as the movement direction (Y-axis direction) of the insertion body 923, a straight path 954*a* formed in the slide in a penetrating manner, and a slit 954 provided with an inclined path 954*b*, and a spring 953 providing a force to move the slide 951, 952 toward the top surface of the case body 911 (toward the position of the first case through hole or the position of the upper cover).

The slide may include a first slide 951 brought into contact with the insertion body 923, and a second slide 952 provided with the slit 954 and configured to transmit the motion of the first slide 951 to the operation part 96. In this case, the spring 953 may be configured to push the first slide 951 toward which the top surface of the case body 911.

Accordingly, when the contact body 921 is brought into contact with the object seated on the upper cover 15, the contact portion 92 and the slides 951 and 952 will move toward the inside of the cabinet 1. However, when the object seated on the upper cover 15 is separated from the contact body 921, the contact portion 92 will be moved toward the cover through hole 151 by the spring 953, and the slides 951 and 952 will move toward the top surface of the case body 911.

The straight path 954*a* may be arranged parallel to the movement direction (Y-axis direction) of the insertion body 923, and the inclined path 954*b* may be arranged at one end of the straight path 954*a* to be inclined toward the case body 911 (toward the first side cover). A connection shaft 957 is inserted into the slit 954, and the second body 963 of the operation part is connected to the second slide 952 by the connection shaft 957. To this end, the second body 963 may be provided with a connection shaft through hole 963*a* through which the connection shaft is arranged.

The position sensor 98 may be configured to sense the magnetic force of the permanent magnet 967 provided in the converter when the drawer panel 25 closes the outlet 113.

When an object such as the second treatment apparatus 200 is seated on the upper cover 15, the permanent magnet 967 fixed to the free end of the operation part 96 is positioned at the second point. When the object is not seated on the upper cover 15, the permanent magnet 967 is positioned at the first point. When the drawer panel 25 closes the outlet 113, the strength of the magnetic force sensed by the position sensor 98 may be greater when the permanent magnet is positioned at the second point than when the permanent magnet is positioned at the first point. Accordingly, the controller C of the first treatment apparatus 100 monitor the strength of the permanent magnet transmitted from the position sensor 98 to determine whether the outlet is closed by the drawer panel and whether there is an object seated on the upper cover 15.

However, the above-described structure of the position sensor 98 is merely an example. That is, a contact sensor (not shown) configured to generate a control signal when contacting the free end of the operation part 96 may be configured as the position sensor 98. In this case, an example of the contact sensor may be a sensor configured to contact the free end of the operation part 96 when the outlet 113 is closed by the drawer panel 25 (a first condition), and the free end of the operation part 96 is positioned at the second point (a second condition) (e.g., a switch sensor, etc.).

Alternatively, the position sensor 98 may be provided with a lamp provided on the mounting body 965 to emit light, and a sensor fixed to the drawer body 21 to sense the intensity or incident angle of light emitted from the lamp. In this case, when the intensity of light emitted from the lamp is greater than or equal to a preset reference value, or when the angle of light emitted from the lamp is less than or equal to a preset reference angle, the position sensor 98 may determine that the inlet is closed by the drawer panel, and the free end of the operation part 96 is positioned at the second point.

In any case, the position sensor 98 may be provided in an area located within a preset reference distance from the second point in the space provided by the drawer body 21 when the drawer panel 25 closes the outlet 113.

While the position sensor 98 is described as being configured to generate a control signal when the free end of the operation part 96 is positioned at the second point, the position sensor 98 may be configured to generate a control signal when the free end of the operation part 96 is positioned at the first point.

The sensor 9 may further include a slide guide providing a movement path for the slides 951 and 952. FIG. 5 illustrates that the slide guide includes a protrusion provided to the second slide 952 and a path defining part provided to the case 91 to define a movement path of the protrusion.

The protrusion may include a first protrusion 955 provided on a surface of the second slide facing the case body 911, and a second protrusion 956 provided on a surface of the second slide facing the case cover 912. The path defining part may include a first protrusion guide 913 provided on the case body 911 to define a movement path of the first protrusion 955, and a second protrusion guide 914 provided on the case cover 912 to define a movement path of the second protrusion 956.

The first protrusion guide 913 may be configured as a groove or slit arranged along the height direction (Y-axis direction) of the case body 911, and the second protrusion guide 914 may be configured as a groove or a slit arranged along the height direction (Y-axis direction) of the case cover 912.

The controller C may operate the driving part 38 only when the drawer panel 25 closes the outlet 113 and the free end of the operation part 96 is positioned at the second point. Stating that the controller C operates the driving part 38 means that the rotor 383 is rotated by supplying current to the stator 381.

When the outlet 113 is opened by the drawer panel 25, or the free end of the operation part 96 is not positioned at the second point, the controller C may control the notification part 254 such that the notification part 254 may output a warning message or a warning sound.

Further, the controller C may be configured to control the operation of the water supplier 6, 7, the drainage part 8, and the driving part 38 according to the control signal transmitted from the position sensor 98. For example, when the outlet 113 is not closed by the drawer panel 25, or when the free end of the operation part 96 is not positioned at the second point, the controller C may limit the operation of at least one of the water supply 6, 7, the drainage part 8, and the driving part 38. Limiting the operation of the water supplier by the controller C means that the valve 61 keeps the connection pipe 6 closed. Limiting the operation of the drainage part by the controller C means that the pump 81 is not operated. Limiting the operation of the driving part 38 means that no current is supplied to the stator 381.

Figure 6A:
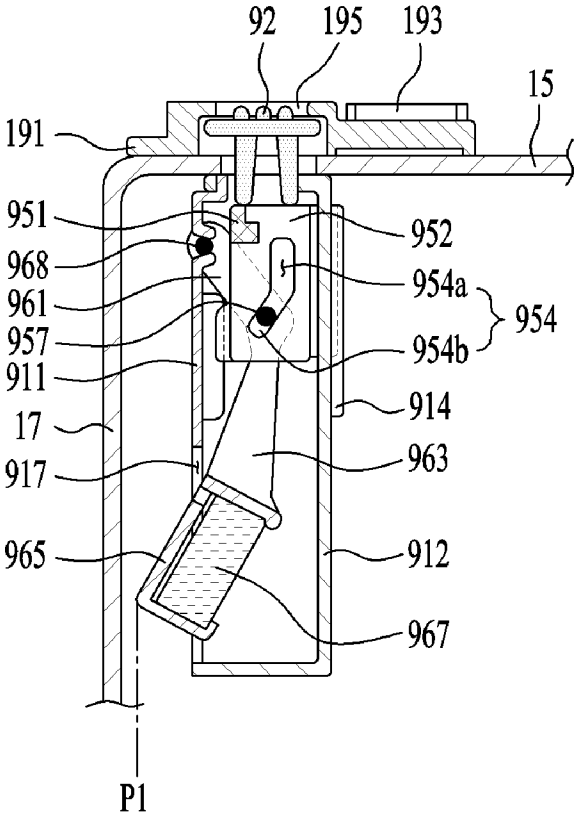

FIG. 6A illustrates a case where an object such as the second treatment apparatus 200 is not seated on the upper cover 15, and FIG. 6B illustrates a case where an object is seated on the upper cover 15 and the outlet 113 is closed by the drawer panel 25.

As shown in FIG. 6A, when the second treatment apparatus 200 is not seated on the upper cover 15, the contact body 921 is positioned in the body through hole 195. This is because the spring 953 provided inside the case 91 provides force to the first slide 951 and the insertion body 923 to move the first slide 951 toward the upper cover 15. In this case, since the connection shaft 957 is positioned on the inclined path 954*b* provided in the second slide, the permanent magnet 967 fixed to the mounting body 965 may be positioned at the first point P1.

When the second treatment apparatus 200 is seated on the upper cover 15, the contact body 921 is moved into the cabinet 1 (toward the top surface of the case) by a pressing part 230 provided to the second treatment apparatus 200. When the contact body 921 moves toward the top surface of the case 91, the insertion body 923 moves the first slide 951 and the second slide 952 toward the bottom surface of the case 91 (away from the top surface of the case). When the first slide 951 moves away from the top surface of the case 91, the spring 953 will be compressed.

When the first slide 951 moves toward the bottom surface of the case 91, the second slide 952 also moves toward the bottom surface of the case 91, and the connection shaft 957 moves from the inclined path 954*b* to the straight path 954*a*. When the connection shaft 957 moves along the straight path 954*a*, the permanent magnet 967 fixed to the free end of the second body 963 fixed to the connection shaft 957 will rotate toward the second point P2.

When the drawer panel 25 closes the outlet 113 while the permanent magnet 967 fixed to the free end of the second body is positioned at the second point, the position sensor 98 will sense that the magnetic force of the permanent magnet 967 is greater than or equal to a reference value. Accordingly, the first treatment apparatus 100 may detect whether the drawer panel 25 has closed the outlet 113 and whether an object such as the second treatment apparatus 200 is seated on the top surface of the cabinet, using one sensor 9.

Unlike shown in the drawing, the sensor 9 may be provided without the case 91. In this case, one end of the operation part 96 may be rotatably fixed to the first side cover 16 through the rotation shaft 968, and the first point P1 may be set as a point closer to the first side cover 16 than to the drawer body 21, and the second point P2 may be set as a point closer to the drawer body 21 than to the first side cover 16.

As mentioned above, the second treatment apparatus 200 may be a washing machine configured to wash laundry (objects to be washed such as clothes and shoes).

The second treatment apparatus 200 may include a second cabinet 210, a second tub arranged inside the second cabinet to provide a space for storing water, a second drum rotatably arranged inside the second tub to store laundry, a leg 220 provided on the bottom surface of the second cabinet and coupled to the leg fastening part 193, and a pressing part 230 configured to move the contact body 921 into the cabinet 1 when the leg 220 is coupled to the leg fastening part 193. The second tub may be supplied with water through a second water supplier, and water stored in the second tub may be discharged to the outside of the second cabinet 210 through a second drainage part.

When the pressing part 230 is configured as a bar protruding from the bottom surface of the second cabinet 210 toward the upper cover 15, the contact body 921 will move toward the inside of the cabinet 1 by its own weight.

The second treatment apparatus 200 may be a dryer configured to dry laundry (objects to be dried such as clothes and shoes). In this case, the second cabinet 210 should be provided with a hot air supplier configured to supply heated air to the second drum.

Although not shown in the drawings, the laundry treatment apparatus 1000 may be configured with the first treatment apparatus 100 alone. In this case, the means to press the contact portion 92 may be replaced with any object capable of moving the operation part 96.

As is apparent from the above, the present disclosure may provide a drawer-type laundry treatment apparatus capable of supporting an apparatus for laundry treatment (such as a dryer, a washing machine, or a drying/washing machine) and washing laundry.

In addition, the present disclosure may provide a laundry treatment apparatus capable of detecting whether a drawer is inserted into a cabinet and whether an object (such as a dryer, a washing machine, or a drying/washing machine) is seated on the top surface of the cabinet, using a single sensor.

It will be apparent to those skilled in the art that the present disclosure may be embodied in other specific forms without departing from the spirit and essential characteristics of the disclosure. Thus, the above embodiments are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A laundry treatment apparatus comprising:

a cabinet that includes:

an upper cover configured to seat an object therein, a first side cover and a second side cover that define a side surface of the cabinet, a cover through hole that is defined at the upper cover, and an outlet defined at a front surface of the cabinet;

a drawer that includes (i) a drawer body configured to be pulled out of the cabinet through the outlet and (ii) a drawer panel coupled to the drawer body and configured to open and close the outlet;

a tub disposed in the drawer body and defining a space for receiving water;

a drum rotatably disposed inside the tub and configured to receive laundry;

an operation part having one end rotatably fixed to the first side cover and an opposite end configured to move between a first point adjacent to the first side cover and a second point adjacent to the drawer body;

a contact portion having one end exposed to an outside of the cabinet through the cover through hole and configured to (i) move toward an inside of the cabinet based on being in contact with the object seated on the upper cover or (ii) move toward the cover through hole based on not being in contact with the object;

a converter configured to (i) move the opposite end of the operation part to the second point based on the contact portion moving toward the inside of the cabinet and (ii) move the opposite end of the operation part to the first point based on the contact portion moving toward the cover through hole; and a position sensor configured to sense a position of the opposite end of the operation part based on the outlet being closed by the drawer panel.

2. The laundry treatment apparatus of claim 1, wherein the position sensor is disposed in the drawer body and configured to be positioned a predetermined reference distance from the second point based on the drawer panel closing the outlet.

3. The laundry treatment apparatus of claim 2, further comprising:

a magnet fixed to the opposite end of the operation part, wherein the position sensor is configured to, based on a magnetic force of the magnet being greater than or equal to a preset reference value, determine that the outlet is closed by the drawer panel and the opposite end is positioned at the second point.

4. The laundry treatment apparatus of claim 2, wherein the position sensor comprises:

a sensor configured to generate a control signal based on the drawer panel closing the outlet and the opposite end being positioned at the second point.

5. The laundry treatment apparatus of claim 2, further comprising:

a lamp disposed at the opposite end of the operation part and configured to emit light, wherein the position sensor is configured to, based on an intensity of light emitted from the lamp being greater than or equal to a preset reference value, determine that the outlet is closed by the drawer panel and the opposite end is positioned at the second point.

6. The laundry treatment apparatus of claim 1, further comprising:

a driving part configured to rotate the drum; and a controller configured to operate the driving part and receive a control signal transmitted by the position sensor, wherein the controller is configured to operate the driving part based on the drawer panel closing the outlet and the opposite end being positioned at the second point.

7. The laundry treatment apparatus of claim 6, further comprising:

a control panel coupled to the drawer panel and disposed at the outside of the cabinet; and a notification part disposed on the control panel and configured to output at least one of a character or a sound, wherein the notification part is configured to, based on the drawer panel not closing the outlet or the opposite end not being positioned at the second point, output a warning message or a warning sound.

8. The laundry treatment apparatus of claim 1, further comprising:

a water supplier configured to supply water to the tub;

a drainage part configured to discharge water stored in the tub to the outside of the cabinet;

a driving part configured to rotate the drum; and a controller configured to operate the water supplier, the drainage part, and the driving part and to receive a control signal transmitted by the position sensor, wherein the controller is configured to skip operating at least one of the water supplier, the drainage part, or the driving part, based on the drawer panel not closing the outlet or the opposite end not being positioned at the second point.

9. The laundry treatment apparatus of claim 1, further comprising:

a case coupled to the first side cover and disposed under the cover through hole; and a rotation shaft configured to rotatably fix one end of the operation part to the case, wherein the contact portion comprises:

a contact body disposed at one end of the contact portion and exposed to the outside of the cabinet through the cover through hole, and an insertion body disposed at the opposite end of the contact portion and passing through the case, the insertion body having one end fixed to the contact body and an opposite end positioned inside the case, and wherein the converter comprises:

a slide configured to move within the case in the same direction as a movement direction of the insertion body, a slit that passes through the slide, the slit having a straight path parallel to the movement direction of the insertion body and an inclined path extending from one end of the straight path to be inclined toward the first side cover, and a connection shaft having one end inserted into the slit and an opposite end fixed to the operation part.

10. The laundry treatment apparatus of claim 9, further comprising:

a protrusion disposed on one of the slide and the case, and a path defining part disposed on the other one of the slide and the case and configured to define a movement path of the protrusion.

11. The laundry treatment apparatus of claim 10, wherein the case comprises:

a case body coupled to the first side cover and configured to rotatably fix the operation part; and a case cover coupled to the case body, wherein the protrusion comprises:

a first protrusion disposed on a surface facing the case body, and a second protrusion disposed on a surface facing the case cover, and wherein the path defining part comprises:

a first protrusion guide disposed on the case body and configured to define a movement path of the first protrusion, and a second protrusion guide disposed on the case cover and configured to define a movement path of the second protrusion.

12. The laundry treatment apparatus of claim 11, further comprising:

an interference prevention hole that is defined to penetrate through the case body and configured to restrict the opposite end of the operation part positioned at the first point from interfering with the case body.

13. The laundry treatment apparatus of claim 10, further comprising:

a case body coupled to the first side cover to rotatably fix the operation part;

a case cover coupled to the case body; and a contact portion guide that passes through a top surface of the case body and is configured to define a movement path of the insertion body.

14. The laundry treatment apparatus of claim 10, further comprising:

a spring configured to press the slide toward the cover through hole.

15. The laundry treatment apparatus of claim 9, wherein the object comprises:

a second cabinet;

a second drum rotatably disposed inside the second cabinet and configured to provide a space to accommodate laundry;

a second driving part configured to rotate the second drum; and a pressing part disposed at the second cabinet and configured to, based on the second cabinet being seated on the upper cover, press the contact portion into the cabinet.

16. The laundry treatment apparatus of claim 15, wherein the object comprises a washing machine configured to wash laundry.

17. The laundry treatment apparatus of claim 16, wherein the object further comprises:

a second tub disposed inside the second cabinet and defining a space configured to receive water;

a second water supplier configured to supply water to the second tub; and a second drainage part configured to discharge water stored in the second tub to the outside of the second cabinet.

18. The laundry treatment apparatus of claim 15, wherein the object comprises a dryer configured to dry laundry.

19. The laundry treatment apparatus of claim 18, wherein the second cabinet comprises a hot air supplier configured to supply heated air to the second drum.

* * * * *